United States Patent [19]

Douwenga

[11] 4,441,304

[45] Apr. 10, 1984

[54] APPARATUS FOR OPENING OUT THE FILLING OPENINGS OF BAGS OF FOIL MATERIAL OR THE LIKE WHICH ARE CONNECTED TOGETHER IN THE MANNER OF A BAND

[75] Inventor: Rudolf Douwenga, Dalen, Netherlands

[73] Assignee: Lockwood International B.V., Nieuw-Amsterdam, Netherlands

[21] Appl. No.: 238,672

[22] Filed: Feb. 27, 1981

[30] Foreign Application Priority Data

Feb. 28, 1980 [DE] Fed. Rep. of Germany ..... 3007588

[51] Int. Cl.[3] ..... B65B 9/08

[52] U.S. Cl. ..... 53/568; 53/562; 53/248; 53/251

[58] Field of Search ..... 53/248, 251, 550, 562, 53/568; 222/271, 281, 414, 272; 221/162

[56] References Cited

U.S. PATENT DOCUMENTS

| | | | |
|---|---|---|---|
| 868,848 | 10/1907 | Davis | 222/414 X |
| 1,805,123 | 5/1931 | Wilcox | 221/162 |
| 2,919,529 | 1/1960 | Hillman | 53/248 X |
| 3,553,924 | 1/1971 | Bonami | 53/248 |
| 3,599,388 | 8/1971 | Feingold | 53/362 X |
| 3,733,633 | 5/1973 | Gustafson | 221/162 X |
| 3,825,152 | 7/1974 | Davis | 222/1 |
| 3,912,122 | 10/1975 | Knapp | 222/281 X |
| 4,169,345 | 10/1979 | Douwenga | 53/568 X |

FOREIGN PATENT DOCUMENTS

| | | | |
|---|---|---|---|
| 52-2954 | 11/1977 | Japan | 53/249 |
| 7614290 | 6/1978 | Netherlands | 53/568 |
| 327554 | 3/1958 | Switzerland | 53/248 |

*Primary Examiner*—John Sipos

*Attorney, Agent, or Firm*—Lyon & Lyon

[57] ABSTRACT

Apparatus for opening the filling openings of bags connected together in the manner of a band. The apparatus includes two conveyor belts between which the opening edges of the bags are guided and each of which is guided around at least one compensating roller displaceable in the direction of movement of the bags. A spreader arrangement engages between the opening edges of the bags and comprises two flexible elements each fixedly mounted at one end and displaceable at the other end, and which together with the associated conveyor belts grip the opening edges of the respective bag and are displaceable in an outward direction by adjuster means for the purpose of forming a filling opening. A rotary member is arranged above at least one of the opening edges of the filling opening substantially parallel to the direction of movement of the bag and is driven in opposition to the filling direction of the filling material.

6 Claims, 6 Drawing Figures

Figure 1:
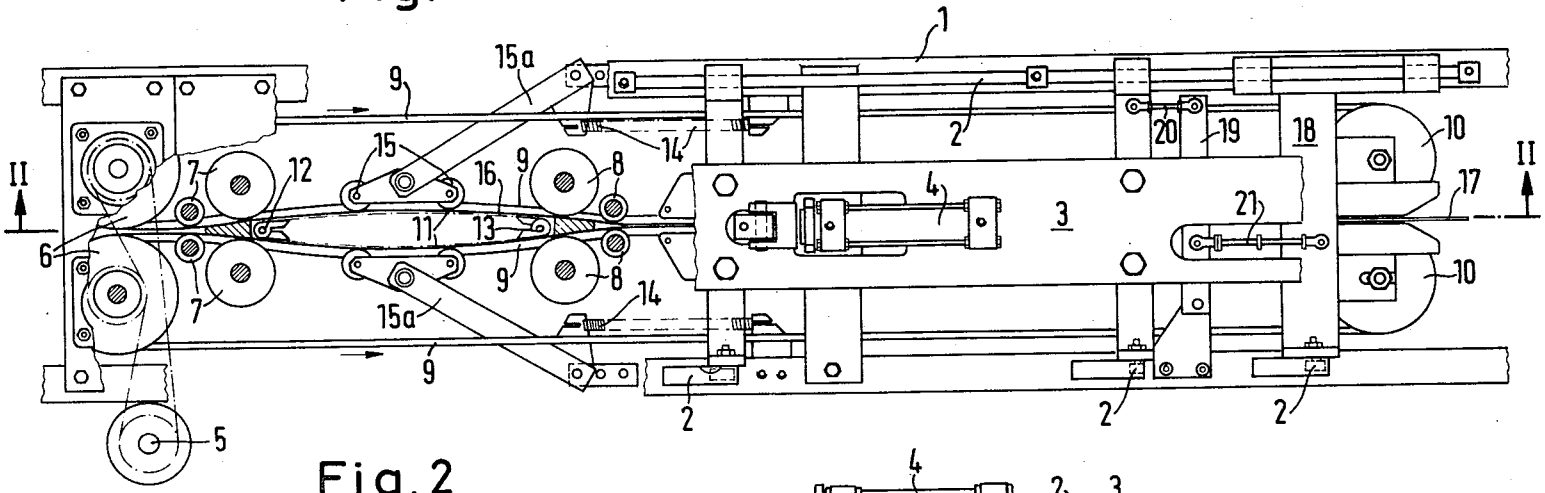

APPARATUS FOR OPENING OUT THE FILLING OPENINGS OF BAGS OF FOIL MATERIAL OR THE LIKE WHICH ARE CONNECTED TOGETHER IN THE MANNER OF A BAND

The invention relates to apparatus for opening out the filling openings of bags of foil material or the like which are connected together in the manner of a band, consisting of two conveyor belts between which the opening edges of the bags are guided and each of which is guided around at least one compensating roller displaceable in the conveyance direction of the bags, and consisting of a spreader arrangement which engages between the opening edges and which comprises two flexible elements each of which is mounted stationary at one end and displaceable at the other end, which together with the associated conveyor belt grip the opening edges of the respective bag and which are displaceable in an outward direction by means of adjuster means.

In known apparatus of the afore-mentioned kind (DE-AS 20 47 774) the flexible spreader elements consist of link chains which are tensioned outwardly for the purpose of forming the filling opening on the respective bag. The adjuster means tensioning outwardly the respective link chain consists of a bowed strap which is provided with the draw bar and which engages the chain approximately in the centre of the filling opening and pulls the chain outwards perpendicular to the conveyance direction of the bags together in the manner of a band. This apparatus comprises certain disadvantages. Since the flexible spreader elements are formed by chains, a rhombus-like filling opening is produced upon outward tensioning of the chains. Because of this rhombus-shaped filling opening, strong deflections of the opening edges of the bags are produced at the corners of the rhombus and may lead to damage of the bag material. Moreover, the chain links likewise subject the bag material to considerable stress, even if the chains are equipped with travelling driver members. These driver members lead to the further disadvantage that the chains must be constructed in a relatively complicated manner and thus are expensive. Furthermore the described stressing of the opening edges of the bags limits the conveyance speed of the bags and thereby the production speed of the apparatus. In the known apparatus, the compensating rollers for the conveyor belts are tensioned by means of spring force. Therefore the further the spreader means and thus the conveyor belts are spread apart during opening the respective bag, the greater becomes the force exerted upon the spreader elements by the tensioned conveyor belts, whereby a considerable friction force is exerted upon the opening edges of the respective bag travelling through between the conveyor belts and the spreader elements. This friction force likewise leads to considerable stressing of the bag material, in particular at high conveyance speeds.

An advantageous known further development of this apparatus consists in that the flexible elements are formed by two elastic blades which are arranged substantially parallel one to the other and which are connected together at their ends by joints located between the blades; the one joint thereof is arranged stationary and the other joint is arranged on a carriage which is displaceable in the direction of the first mentioned joint; and that the compensating rollers are located on a support which is displaceable together with the carriage and which is connected to the carriage by means of a differential gear.

By means of these elastic blades a substantially oval filling opening may be formed which permits uniform opening and closing of the opening edges of the bags without abrupt deflections. Thereby this apparatus permits a high conveyance speed of the bags and thus a high filling speed, without inadmissible stressing of the material of the bags to be feared. Even the entry of the opening edges of the bags between the blades and the associated conveyor belts occurs without a strong change of direction and therefore without problems. The same is true for the discharge of the bag after filling.

According to the invention the axes of the joints are arranged relatively to the blades in such a manner that a satisfactory lever arm is ensured which leads necessarily to the blades being spread apart. This is achieved by the fact that the joints are arranged between the blades. Thereby a satisfactory lever arm is necessarily produced between the respective joint axis and the blades, so that outward spreading apart of the blades takes place reliably when the joint locations approach each other.

By means of the differential gear by which the compensating rollers of the conveyor belts are controlled dependently upon the opening movement of the spreader blades, any desired pre-selectable tensioning force can be adjusted between the conveyor belts and the spreader blades independently of the opening width. Thereby the friction force exerted upon the opening edges of the bags when the opening edges travel through between the conveyor belts and the spreader blades can be maintained at a desired low value, so that low stressing of the bag material prevails even at high conveyance speeds. This, too, leads to high operational reliability of the apparatus according to the invention at high conveyance speeds.

Moreover, this apparatus excels by a simple construction and by a high operational reliability. The opening and closing movement of the blades can be obtained by means of extremely simple construction components. The control of these construction components does not lead to problems. Altogether apparatus has been provided which excels by high conveyance speed and thus filling speed and by high operational reliability.

The aforementioned advantages suffer a certain limitation by the fact that a risk cannot be excluded in that respect that the filling opening becomes blocked and thus a perfect filling process for attaining the aforementioned operating speed of the machine is not ensured.

Therefore the object of the invention resides in the further development of the apparatus referred to above in such respect that blockage of the filling opening is avoided with certainty.

This problem is solved in that a rotary member, in particular as a roller, is arranged above at least one of the opening edges of the filling opening and is rotatably mounted on a shaft directed substantially parallel to the conveyance direction of the filling material and is driven in opposition to the filling direction of the filling material.

In the more general sense of the invention this roller is associated with a filler duct having a rigid filling opening.

In case the filling opening becomes blocked, the oppositely driven roller ensures that the accumulation is loosened up and the blockage is removed, in order that a continuous filling process is ensured.

This solution is found to be particularly advantageous when a filler duct adjusted to the cross-section of the filling opening is arranged above the latter and is connected to a conveyor belt transverse to the conveyance direction of the foil material, since in such a case an increased risk of a blockage is to be expected.

In respect of optimum adjustment and optimum influence on the filling material of the roller, the latter comprises a concave rotation-symmetrical surface the contour of which is adjusted to the filling opening and the filler duct connected thereto.

In this case the contour of the roller may be flush with the substantially vertical wall of the filler duct located above the respective opening edge, or however it may project a little into the filler duct under certain circumstances.

In order to ensure perfect functioning of the roller and to improve the filling process a cover plate is disposed between the roller and the conveyor belt; on the one hand the cover plate is fastened to the filler duct, and on the other hand it overlaps partly the roller, being adjusted to the contour of the latter.

In order to ensure contact with the filling material which contact is gentle on the one hand, but effective, at least the surface of the roller may consist of rubber or synthetic resin material, or may be equipped with bristles which are arranged in tight mutual rows. However, the surface of the roller may alternatively be uneven in such a manner that the surface is provided with rotation-symmetrical peripheral grooves.

Figure 2:
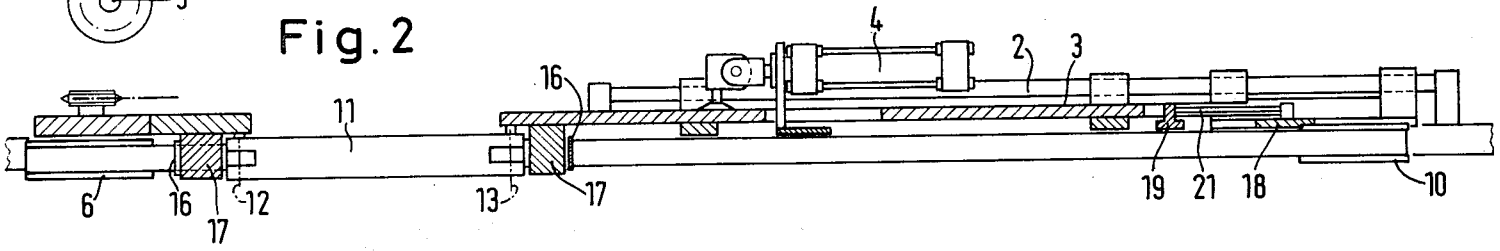
Figure 3A:
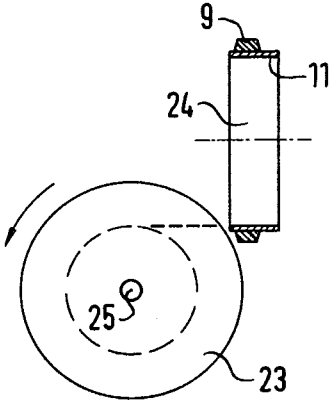
Figure 3:
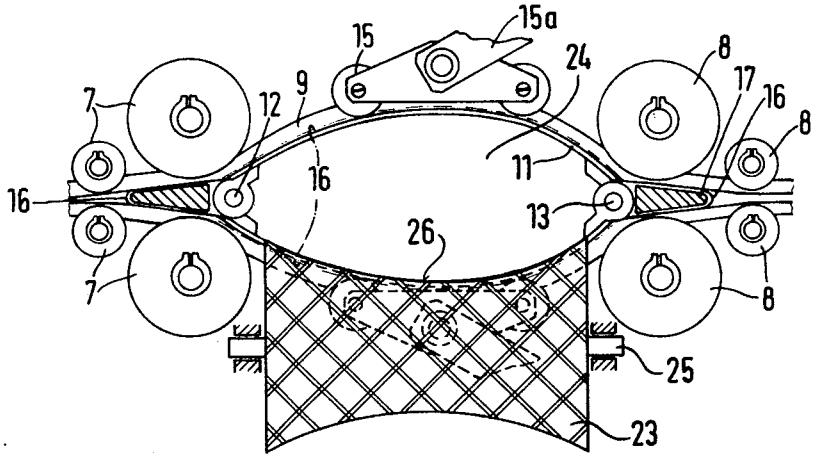
Figure 4:
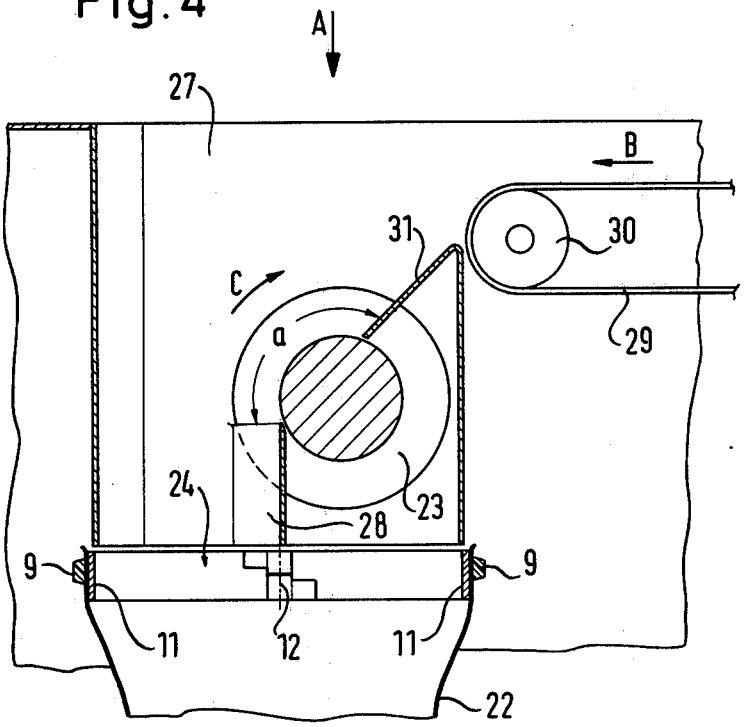
Figure 5:
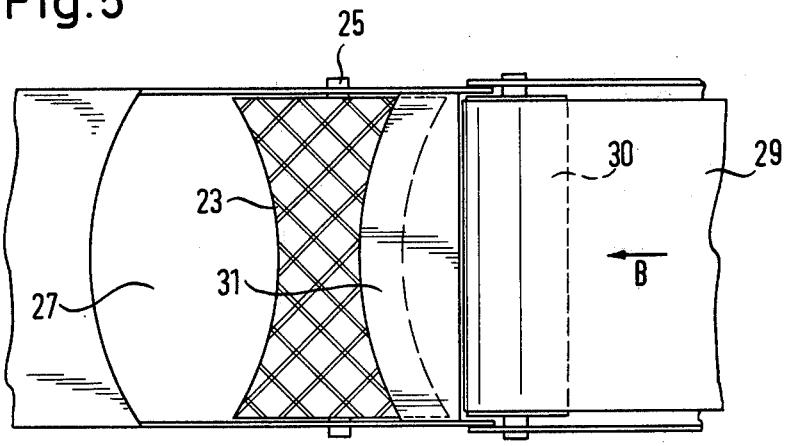

The invention is described below with reference to a constructional example illustrated in the drawings. There are shown in:

FIG. 1, a diagrammatic, partly sectional view from above upon apparatus according to the invention, without illustrating of the roller according to the invention;

FIG. 2, a longitudinal section through the apparatus in accordance with the section line II—II of FIG. 1;

FIG. 3, the essential constructional components of the apparatus in the position in which the bag located therein is open, including the illustration of the roller according to the invention;

FIG. 3*a*, a diagrammatic illustration of the roller and the filling opening without the adjacent parts;

FIG. 4, a diagrammatic illustration of a filler duct and a conveyor belt above the filling opening, and FIG. 5, a view from above upon the installation according to FIG. 4 in the direction of the arrow A.

The apparatus for opening out the filling openings of a longitudinally folded foil web divided into individual bags comprises a mounting frame 1 on which are arranged two guide devices 2 which are parallel one to the other and to the conveying direction of the foil web and on which a carriage 3 is displaceable by means of a pneumatically operated actuating device 4. The movement of the foil web is effected by means of two mutually parallel conveyor belts 9 which grip the opening edges of the foil web and guide them. The drive and the guidance of the conveyor belts 9 is effected by appropriately arranged belt wheels 6, 7 and 8 mounted on the frame 1. Whereas the belt wheels 6 are driven by an electric motor 5, the belt wheel pairs 7 and 8 rotate idly therewith. Belt wheels not described in detail may be disposed in a freely rotatable manner also on the carriage 3.

For the purpose of opening the filling openings of the individual bags conveyed in a stepwise manner, a spreader device is provided which is formed by two blades 11 arranged parallel one to the other and to the direction of movement of the foil web and the individual bags. The blades 11 engage between the opening edges of the respective bags and clamp same in co-operation with the associated conveyor belts 9. At their adjacent ends the two blades are connected together in a hinge-like manner by means of joints 12 and 13. Whereas the joint 12 is stationary on the mounting frame 1, the joint 13 is associated with the carriage 3 and is displaced together with the carriage 3.

Opening of the filling opening of the respective bag is effected in that the carriage 3, and thereby the joint 13, is displaced in the direction of movement of the foil web in the direction of the joint 12, whereby the blades 11 are spread apart one from the other. This movement is also performed by the conveyor belts 9 due to an arrangement still to be described in detail. Due to the spreading-apart movement of the blades 11 and the conveyor belts 9, the opening edges of the bag which are clamped between the said constructional components, are likewise moved apart, whereby the filling opening of the bag is produced. After filling has been effected the filling opening of the bag is closed again in that the blades 11, together with the conveyor belts 9, are again moved towards each other, as the carriage 3 taking with it the joint 13 is moved back again. The full bag closed again in the manner just described is withdrawn from the blades 11 by the conveyor belts 9 and the opening edges of the next following bag to be filled are pushed upon the blades 11.

In order that the conveyor belts 9 can follow the described movements of the blades 11, they are led around compensating wheels 10 mounted on a support 18 which is displaceable along the guide rods 2. The synchronisation of the movement of the displaceable support 18 relatively to the movement of the carriage 3 is effected by a lever 19 which on the one hand is rotatably connected to the mounting frame 1 and on the other hand co-operates with the carriage 3 by means of two coupling rods 20 and 21. The coupling rod 20 is pivotally connected to a support of the carriage 3 and to the lever 19, whilst the coupling rod 21 is pivotally connected to the lever 19 and to the support 18. The points of engagement of the coupling rods 20 and 21 on the lever 19 are so selected that during the opening and closing movement of the blades 11 the conveyor belts are just held under tension.

In order to obtain in the region of the blades 11 precise guidance of the conveyor belts 9 in spite of the reciprocatory movement, the conveyor belts 9 are additionally guided in the region of the blades 11 by guide wheels 15 mounted on arms 15*a* which are pivotally mounted on the frame 1. The arms 15*a* are subjected to the effect of springs 14 in such a manner that the guide rollers 15 are always urged in the direction of the blades 11.

In order to obtain accurate and problem-free entry of the opening edges of the bags between the blades and the associated conveyor belts 9, a respective spreader element 17 is provided at the entry end as well as at the exit end. The spreader element 17 at the inlet end is enlarged in a wedge-like manner, whilst the spreader element 17 at the exit end tapers approximately in the conveying direction. For further improvement of a trouble-free entry of the opening edges of the bags between the blades 11 and the associated conveyor belts 9 it is advisable to arrange a V-shaped strip 16 of resilient material around the respective spreader element 17. This strip may additionally extend also between the blades 11 and the associated conveyor belts 9.

The described apparatus is capable of manipulating accurately not only bags of foil material, but also of other materials, such as netting or the like.

As may be seen clearly from FIG. 3, a roller 23 is located above the one opening edge of the filling opening 24, the roller 23 being rotatably mounted on a shaft 25 directed substantially parallel to the direction of movement of the foil material. As may be seen in particular from FIG. 3, the surface of the rotation-symmetrical body has a concave generatrix 26 which is preferably adjusted to the contour of the opening edge. Preferably the generatrix 26 is flush with the one opening edge of the completely opened filling opening 24. Alternatively, however, the generatrix 26 may project a little into the filling opening.

In FIG. 4 the apparatus illustrated in FIGS. 1 and 2, in as much as it relates to the filling region, is arranged below a filler duct 27, the cross-sectional area of which is adjusted substantially to the cross-section of the filling opening 24. In this illustration the roller 23 is illustrated is cross-section and it must be assumed in this case that the shaft of the roller is mounted in the walls of the filler duct. As may be seen from FIG. 4, the roller 23 is partly hidden behind the wall 28 of the filler duct which wall has the contour of an opening edge of the filling opening. A conveyor belt 29 is located obliquely above the roller 23 and runs over a guide roller 30 positioned adjacent the front of the roller 23. The conveying run of the conveyor belt 29 travels in the direction of the filler duct as indicated by the arrow B and supplies the material to be filled. The roller 23 moves in the direction opposite thereto as indicated by the arrow C, i.e. against the filling direction of the filling charge. The conveyor belt 29 is connected to a cover plate 31 located closely above the roller and which, in respect to its lower edge, is adjusted to the concave contour of the roller 23. This means that only the upper sector a of the roller 23 is exposed and can affect the filling charge.

When the filling charge is supplied by means of the conveyor belt 29, the same falls upon the cover plate 31 and from there over the sector a of the roller 23 into the filler duct 27 and from there through the filling opening into the bag 22.

If an accumulation occurs within the filler duct 27, the former is resolved as soon as the accumulation reaches the roller 23, since the roller is opposed to the filling direction of the filling charge and therefore has a loosening effect. Thereby rapid and undisturbed filling is possible even when the installation is operated at a high speed.

I claim:

1. Apparatus for opening the filling openings of bags connected together in the manner of a band, consisting of two conveyor belts between which the opening edges of the bags are guided, and each of which is guided around at least one compensating roller displaceable in the direction of movement of the bags, a spreader arrangement which engages between the opening edges of the bags and comprises two flexible elements each fixedly mounted at one end and displaceable at the other end, and which together with the associated conveyor belts grip the opening edges of the respective bag and are displaceable in an outward direction by adjuster means for the purpose of forming a filling opening, a filler duct adjusted to the cross-section of the filling opening is arranged above the latter providing a path for the filling material and is connected to a conveyor belt transverse to the direction of movement of the bags, a rotary symmetrical roller member mounted below said conveyor belt and under said filling material path so that the filling material is adapted to pass over said roller and arranged above at least one of the opening edges of the filling opening and rotatably mounted on a shaft extending substantially parallel to the direction of movement of the bag, said member being driven in opposition to the filling direction of the filling material, the surface contour of the roller being concave and adjusted to that of the filling opening and the filler duct connected thereto, and wherein a cover plate is arranged between the roller and said transverse conveyor belt and is fastened to said filler duct and partly covers the roller being adjusted to the contour of the latter.

2. Apparatus according to claim 1, wherein the contour of the roller is flush with the substantially vertical wall of the filler duct located above the respective opening edge of the filling opening.

3. Apparatus according to claim 1, wherein at least the surface of the roller consists of rubber.

4. Apparatus according to claim 1, wherein at least the surface of the roller consists of synthetic resinous material.

5. Apparatus according to claim 1, wherein at least the surface of the roller consists of bristles disposed in mutually tight rows.

6. Apparatus according to claim 1, wherein the surface of the roller is provided with rotation-symmetrical peripheral grooves.

* * * * *